US005822798A

United States Patent [19]

Baxley

[11] Patent Number: 5,822,798

[45] Date of Patent: Oct. 20, 1998

[54] HAIR BAND

[76] Inventor: Frances J. Baxley, 9009 Western Lake Dr., Jacksonville, Fla. 32256

[21] Appl. No.: 621,844

[22] Filed: Mar. 25, 1996

[51] Int. Cl.[6] ..... A42C 5/00

[52] U.S. Cl. ..... 2/182.6; 2/171; 2/174; 2/182.1; 2/DIG. 11; 132/273; 132/275

[58] Field of Search ..... 2/171, 174, 182.1, 2/182.6, DIG. 11; 132/273, 275

[56] References Cited

U.S. PATENT DOCUMENTS 3,211,160 10/1965 Miller ..... 132/275
4,892,110 1/1990 Harvie ..... 132/273
5,572,746 11/1996 Linico ..... 2/182.1
5,625,901 5/1997 Healy ..... 2/182.1

*Primary Examiner*—Diana Biefeld
*Attorney, Agent, or Firm*—Thomas C. Saitta

[57] ABSTRACT

A strip shaped hair band having on its hair engaging surface a multiplicity of minute fibre retentive members with, in its preferred embodiment, a strip of decorative backing materials to create a pleasing external appearance, and a strip of ductile material intermediate these two strips to provide shape retentive and compressive capabilities.

14 Claims, 2 Drawing Sheets

HAIR BAND

BACKGROUND

1. Field of the Invention

This invention is related generally to the field of hair fastening and holding devices such as head bands and pony tail holders. More particularly, it is concerned with the design of such devices utilizing a surface with a multiplicity of minute fibre retentive projections thereon as a means for engaging the hair held therein.

2. Prior Art in the Field a. Hair Fastening Devices

Devices and means, both chemical and mechanical, for the fastening or maintenance of hair in desired shapes and forms have been designed and sought from the earliest known historical periods. Chemical means in current use include a wide variety of chemical adherents such as those used in hair sprays and hair mousse. Mechanical means in current use include a wide variety of hair bands and pony tail holders. Head bands typically fit over the top of the head downward to (or behind) the ears of the user. Those in current use are generally somewhat stretchable, and grip the sides of the head when placed into position by the user. Pony tail holders generally take the form of a closed or closeable band which closes tightly around the hair enclosed therein. A representative sampling U.S. Patents reflecting the current state of the art as it pertains to such mechanical hair holding means may be found in the following patents:

a) U.S. Pat. No. 2,393,376 for a "Hair Retainer" issued to C. C. Holden in 1946, describes a hair holding device featuring spiraling "teeth" by which the device can, supposedly, be twisted into an engaged position gripping the hair of the user.

b) U.S. Pat. No. Des. 167,553 for a "Hair Holder" issued to S. Behr in 1952, illustrates the design of a rigid circular pony tail holder having opposed "teeth" on its inward surface.

c) U.S. Pat. No. 2,805,673 for a "Hair Holding Band" issued to N. L. Soloman in 1957, describes a belt-like adjustable pony tail holder.

d) U.S. Pat. No. 2,945,500 for a "Pony Tail Holder and Method of Making the Same" issued to G. N. Bolinger in 1958, describes a pony tail holder having decorative features which fastens with snaps.

e) U.S. Pat. No. 3,000,384 for a "Fastener Tie" issued to E. F. Piers, Jr., in 1961, describes a pony tail holder which utilizes Velcro® fasteners.

f) U.S. Pat. No. 3,542,041 for "Hair Fasteners and Methods of Using the Same" issued to D. Mercorella in 1970, describes a further variant pony tail holder that utilizes Velcro® fasteners.

g) U.S. Pat. No. 4,785,834 for a "Hair Gripper Device" issued to M. Gonzalez in 1988, describes a pony tail holder fastenable by snaps or other means with an elastic member on the inward surface thereof to compress and grip the hair enclosed by the pony tail holder.

h) U.S. Pat. No. 4,892,110 for a "Hair Wrap Device" issued to P. Harvie in 1990, utilizes a flat ductile metallic strip capable of retaining its coiled shape when coiled about a bundle of human hair as a pony tail holding means.

i) U.S. Pat. No. 5,318,054 for a "Spiral Spring Hair Barrette Assembly" issued to K. Neilson et al. in 1994, describes a spiral spring hair barrette assembly for holding pony tails.

As will be observed upon review of the foregoing patents, most mechanical hair holding means generally rely on one of two possible means for gripping the head and/or hair of the user and maintaining the hair holding device (and the hair it holds) in the position desired. One way has been via direct compression such that frictional pressures serve to maintain the hair holding device (and the hair it holds) in the desired position. (See, e.g., U.S. Pat. Nos. 2,805,673; 3,000,384; 3,542,041; and 4,785,834, above). An alternate means, which is generally practiced in conjunction with the first means described is to provide the inward surface of the hair holding device with rigid "teeth" which engage the hair strands enclosed in the device and are intended to supplement the frictional gripping action of the device. (See, e.g., U.S. Pat. Nos. 2,393,376; Des. 167,553; and 5,318,054, above). Unfortunately, it has been found in practice that neither the first nor the second method described serve to practically and effectually hold hair with minimal damage to the strands enclosed thereby and maximum comfort to the user. Pony tail holding devices have an innate tendency to slip down and out of position. This tendency is exacerbated when the pony tail holder is loose. However, pony tail holders which exert sufficient pressure to hold them in position in the hair tend to damage the strands held therein. Current head band designs are, likewise, unsatisfactory. They must be produced in such manner as to firmly engage and grip the sides of the head to perform their desired function. However, head bands that exert sufficient pressure to hold them in position on the head and hair are, if not damaging to the hair held therein, generally uncomfortable for the wearer. Indeed, most tend to cause intense discomfort and headaches after prolonged use, and some may do so almost immediately. These problems are (with regard to both pony tail holders and head bands) only exacerbated by the addition of rigid "teeth" to the surfaces of the device that contact the hair or head of the user.

b. Fabric Engaging Surfaces

Fabric engaging surface materials have been known since the invention of the hook and loop fabric fastening system developed in 1941 by George de Mestral and originally marketed under the tradename VELCRO. (Similar products are now available from other manufacturers). The hooked surface of a hook and loop system is capable of engaging the looped fabric with which it is used in such manner as to form a nonpermanent mechanical bond. In this system, the hooked surface is covered with numerous small flexible plastic projections. These projections are typically in the form of small loops or rings which are joined at one point along their circumference with the surface of the material so as to be perpendicular thereto and have a break or opening at some other point in their circumference. The configuration described creates a gating mechanism such that a fibre strand or strands pressed against the surface will displace the material of the extension sufficiently to open the "break" and/or will otherwise become entrapped therein. The extensions are, however, flexible enough to be opened again so as to allow the fibres entrapped within the loops described to escape when sufficient force is exerted to pull the two surfaces apart.

SUMMARY AND OBJECTS OF THE INVENTION

The primary object of the instant invention is to provide hair holding devices such as head bands and pony tail holders that, by virtue of the unique and novel inventive concepts embodied therein, will firmly grip and engage the hair of the user without the use of rigid teeth or excessive pressures. This object is accomplished by the inventor's development of novel hair holding devices that mechanically engage the hair strands of the user via a multiplicity of minute flexible fibre engaging projections on the surfaces of the devices worn next to the user's hair. The fibre engaging projections are curved in a hook shape or have enlarged ends on a thin stem to form a mushroom shape. This development and invention, with the other and additional subsidiary concepts and improvements described herein, results in the production of hair holding devices that are simple and inexpensive to manufacture, light in weight, and highly efficient and effective in accomplishing their intended purposes. The mode and method by which these devices fulfill the aforesaid objectives will become readily apparent upon review of the drawings, and the detailed description and claims which follow.

DETAILED DESCRIPTION OF THE PREFERRED EMBODIMENT

Figure 1:
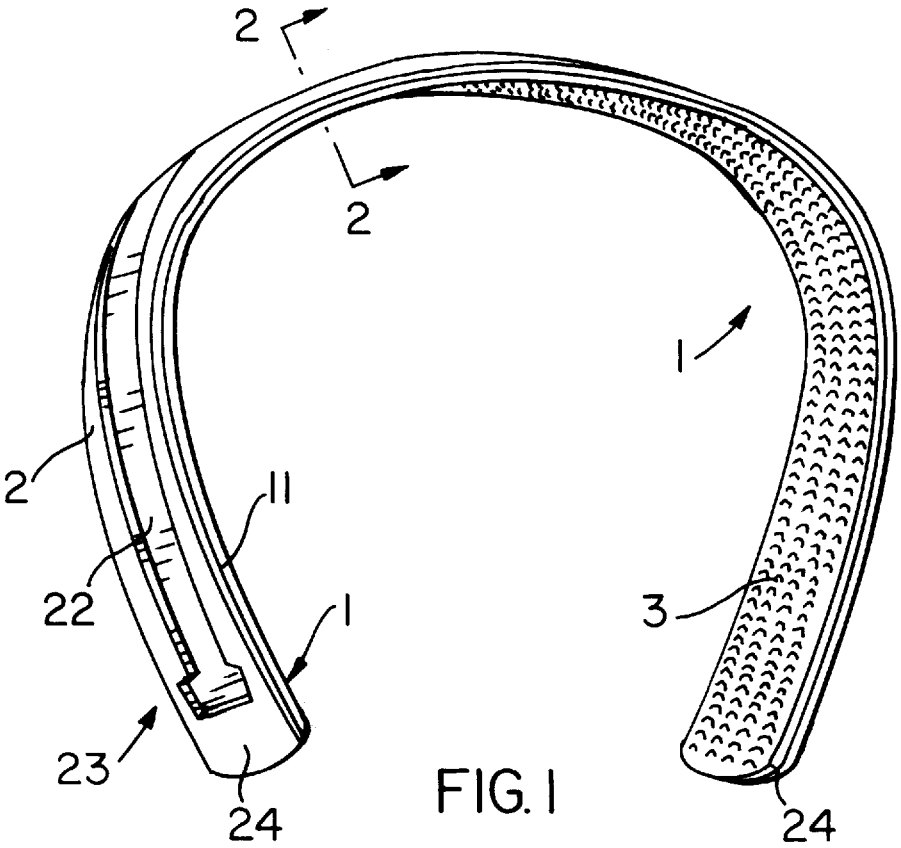
FIG. 1 provides a perspective view of a first embodiment of the instant invention.
Figure 2:
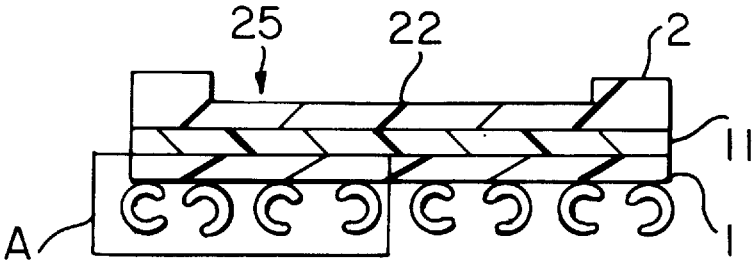
FIG. 2 provides a cross-sectional view taken through the line 2—2 of FIG. 1.

FIGS. 1 and 2 illustrate a first embodiment of the instant invention, wherein the inventive concept is applied to the design of a head band. As will be noted upon review of these figures, the embodiment illustrated utilizes the hooked surface 1 of a VELCRO fastener on its underside as a hair engaging means. It is provided with a ductile strip 11 capable of withstanding repeated bending in order to make it adjustable and adaptable to the head of the user. (In the embodiment illustrated a copper strip 0.032 inches in width is utilized; however, this element may be eliminated and/or other materials and features may be utilized for this same purpose). Bracket 2 may be formed from plastic or some other material and serves as means for holding decorative backing 22 (which may be inserted via gap 23) in its desired position such that the decorative backing 22 is visible through aperture 25. The hair band illustrated may vary in length, but should optimally be in the range of approximately 18 inches with the corners at its ends 24 rounded, as shown, for comfort.

Figure 4:
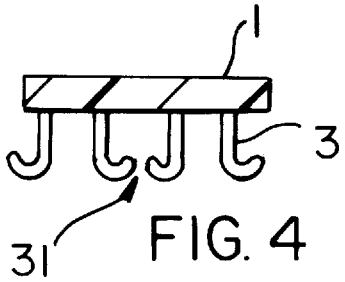
FIG. 4 provides an enlarged fragmentary view of box A in FIG. 2 further illustrating features of a first embodiment of the hair engaging surfaces of the instant invention.

FIG. 4 provides an enlarged fragmentary view further illustrating the VELCRO hook surface utilized as a hair engaging means on the underside of one preferred embodiment of the instant invention. As is well known in the mechanical arts, VELCRO fasteners generally rely on two surfaces, a first surface covered with flexible looped fabric strands and a second surface (as illustrated in FIG. 4) covered with small flexible plastic hooks 3. When the two surfaces are pressed together, the hooks 3 become entangled and enmeshed in the looped fabric surface, forming a firm but breakable mechanical bond between the two surfaces. Thus, VELCRO fasteners have found a variety of uses in applications throughout the mechanical arts, particularly in areas concerned with garment manufacture. However, in the instant invention, only the hooked surface 1 of the VELCRO fastener is used for the purpose of engaging the hair strands of the user. The presence of this type of surface on the headband illustrated in FIGS. 1 and 2 and the other embodiments of the instant invention, allows the production of a hair holding device that has pronounced hair holding capabilities without the use of excessive pressure either on the head of the user (in the case of a head band) or on the strands of hair enclosed thereby (in the case of a pony tail holder)

The manner of use for the embodiment shown in FIGS. 1 and 2 illustrates the foregoing point. The hair band disclosed may be used by simply placing same in its desired position over the head with the hooked surface 1 facing the head/hair of the user and gently pressing it into the hair underneath. The hooks 3 of hooked surface 1 engage the hair of the user in such manner that the embodiment illustrated will, without pressure on the head of the user, maintain its position on the head and in the hair. This embodiment could also be lengthened so as to be of a length allowing it to completely encircle the head and hair of the user in the manner well known in the art of head bands. In this circumstance, numerous means are available to allow it to be adjusted to the dimensions necessary for this purpose. Thus, it could be provided with a strip or strips of VELCRO loop surfaces (as described in more detail with reference to FIG. 3, below) on one of its ends 24 so as to allow the hooked surface 1 to overlap and fasten thereon. Another alternative would be to join the two ends of the embodiment by an elastic strip so as to form a continuous loop that is able to stretch slightly for placement.

Figure 3:
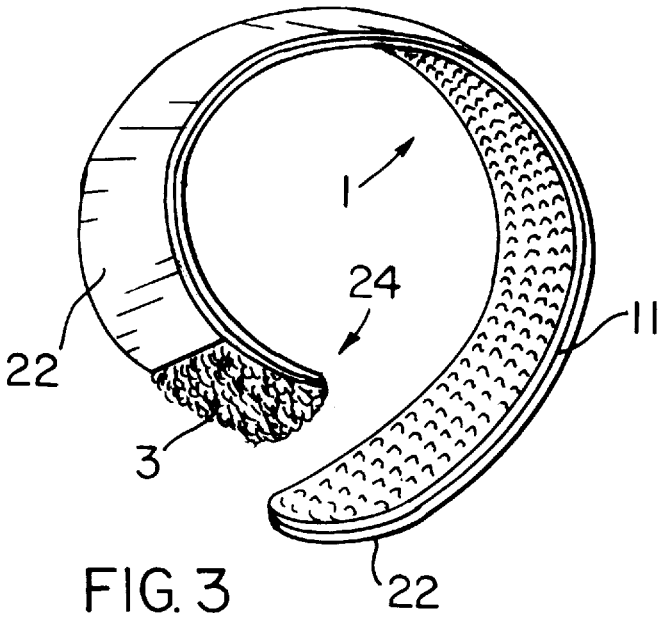
FIG. 3 provides a perspective of a second embodiment of the instant invention.

A pony tail holder in accordance with the teachings of this invention may be produced by shortening the length of the last embodiments described above-i.e.-by producing an embodiment of suitable length with means allowing it to completely encircle the hair to be formed into a pony tail. An embodiment allowing such is illustrated in FIG. 3. In this figure as in FIGS. 1 and 2, a hooked surface 1 is provided with a decorative backing 22. In addition, a looped VELCRO surface (looped surface 3) is provided at one end 24 to allow the hooked surface 1 of the pony tail holder to overlap the looped surface 3. Thus, in order to use this embodiment, the band is merely placed into position, tightened in a loop around the hair to be fastened into a pony tail such that hooked surface 1 overlaps looped surface 3 and these two surfaces pressed together in the manner typically used with VELCRO fasteners. Finally, to increase the pressure and the hair strands enclosed therein and to thereby increase the retentive capabilities of the pony tail holder, the holder can be squeezed so as to force the ductile material therein into a flattened configuration. It should be noted, however, that (as previously noted in relation to hair bands) the means by which a continuous loop of adjustable length is produced may be varied somewhat without exceeding the scope of the inventive concept.

Figure 5:
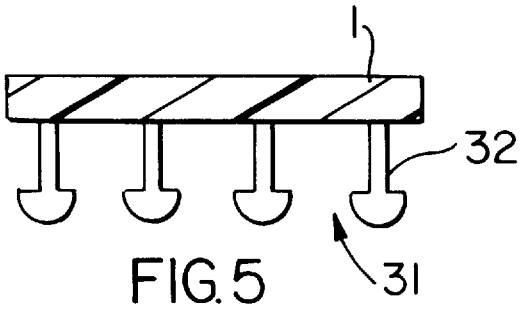
FIG. 5 provides an enlarged fragmentary view of box A in FIG. 2, illustrating features of a second embodiment of the hair engaging surfaces of the instant invention.

FIG. 5 illustrates an alternate form for the multiplicity of minute fibre retentive projections disposed on the underside of hair bands produced in accordance with the teachings of this invention. In this embodiment, a multiplicity of flexible mushroom shaped members 32 form the fibre retentive projections. The mushroom shaped members 32 have a broad, enlarged head mounted onto a relatively thin stem and are positioned relatively near each other. The surface shown is produced by the 3M Company under the trade name "Dual Lock Reclosable Fasteners." As advertised and developed by this company, this surface is intended to engage and interlock with another surface having mushroom shaped projections. However, it has been determined that this material will also act as a hair fibre retentive/engaging surface of the type intended for employment in this invention. In this regard, it will be noted that the surfaces discovered to be useful for the purposes of this invention and claimed herein are provided with minute flexible projections which form, either in conjunction with each other (as with the mushroom shaped members 32) or individually (as with VELCRO type hooks 3) flexible openings or gates 31 through which locks of hair and/or individual hair strands can pass and within/behind/under which they can be non-permanently trapped/retained. Currently available surface materials of this type vary greatly in the number of projections per square inch and their configuration. It has been found that for best results:

1. 100 to 400 projections per square inch form an optimum number for the purposes of this invention.

2. Where hook type projections (such as those manufactured under the tradenames VELCRO and SCOTCHMATE) are used, the rows of projections should be disposed in such manner as to be parallel to the direction of the hair held by the hair band rather than perpendicular thereto.

3. Where VELCRO brand hook type projections are utilized optimum results are achieved with its "Hook 88"product which is provided with 400 projections per square inch at 8 mm diameter.

4. The SCOTCHMATE brand hook type projections also achieve optimum results and are provided with 400 projections per square inch.

5. Where Dual Lock brand mushroom type projections are utilized, optimum results are achieved with its "SJ3442" product which is provided with 170 projections per square inch.

Numerous variations in the foregoing described details are, however, possible without exceeding the scope of the inventive concept disclosed herein. Such variations would include composition, configuration (namely orientation of projections in relation to hair strands and themselves), density (in terms of numbers per unit or area), shape or hook or gating structure, plurality of hair engaging means per projection, angle of projection from the surface of the hair band, and flexibility. All such variations may affect the hair engaging properties of the invention described herein. Such variability is desirable in that certain hair types or lengths require variations of the type discussed above in order to achieve optimum performance in terms of comfort, hair holding capability, and ease of application and removal or the hair band. The backing of the hair band from which the hair engaging members/projections protrude can also be composed of various materials (e.g.-leather, fabric, plastic, etc.) which by their nature can enhance the function of the hair engaging members/projections. Thus, by way of example, an extremely stiff backing may in some cases detract from the function of the hair band by not allowing same to optimally conform to the shape of the head and hair, thereby preventing the hair engaging members/projections from optimally engaging the hair of the user. A more flexible material is, therefore, desired. Thus, as is apparent from the foregoing, the full scope of the instant invention can best be determined by review of the claims which follow.

I claim:

1. In a hair band having projections to maintain the hair band in place, the improvement where said projections comprise flexible fibre retentive members which mechanically engage hair fibres to maintain the hair band in place, wherein said fibre retentive members are mushroom shaped.

2. The hair band of claim 1, where said hair band comprises at least approximately 100 fibre retentive members per square inch.

3. The hair band of claim 2, where said hair band comprises no more than approximately 400 fibre retentive members per square inch.

4. In a hair band having projections to maintain the hair band in place, the improvement where said projections comprise flexible fibre retentive members which mechanically engage hair fibres to maintain the hair band in place, wherein said hair band comprises at least approximately 100 fibre retentive members per square inch.

5. The hair band of claim 4, where said flexible fibre retentive members are hook shaped.

6. The hair band of claim 5, where said hook shaped fibre retentive members are aligned in parallel manner.

7. The hair band of claim 4, where said hair band comprises no more than approximately 400 fibre retentive members per square inch.

8. A hair band worn on a person's head to retain hair fibres in place comprising hair engaging means comprising flexible fibre retentive members having flexible openings therebetween to receive and retain hair fibres in mechanical engagement, where said fibre retentive members are mushroom shaped.

9. The hair band of claim 8, where said hair band comprises at least approximately 100 fibre retentive members per square inch.

10. The hair band of claim 9, where said hair band comprises no more than approximately 400 fibre retentive members per square inch.

11. A hair band worn on a person's head to retain hair fibres in place comprising hair engaging means comprising flexible fibre retentive members having flexible openings therebetween to receive and retain hair fibres in mechanical engagement, where said hair band comprises at least approximately 100 fibre retentive members per square inch.

12. The hair band of claim 11, where each said fibre retentive member has an enlarged end mounted onto a stem.

13. The hair band of claim 11, where said fibre retentive members are hook shaped.

14. The hair band of claim 11, where said hair band comprises no more than approximately 400 fibre retentive members per square inch.

* * * * *